United States Patent [19]

Whitefield et al.

[11] 4,352,312

[45] Oct. 5, 1982

[54] TRANSIENT HARMONIC INTERPOLATOR FOR AN ELECTRONIC MUSICAL INSTRUMENT

[75] Inventors: John T. Whitefield, Harleysville; Robert P. Woron, Allentown, both of Pa.

[73] Assignee: Allen Organ Company, Macungie, Pa.

[21] Appl. No.: 272,223

[22] Filed: Jun. 10, 1981

[51] Int. Cl.[3] ..... G10H 1/057; G10H 1/08; G10H 7/00

[52] U.S. Cl. ..... 84/1.21; 84/1.13; 84/1.22; 84/1.26

[58] Field of Search ..... 84/1.11–1.13, 84/1.19–1.24, 1.26

[56] References Cited

U.S. PATENT DOCUMENTS

| | | | |
|---|---|---|---|
| 3,610,805 | 10/1971 | Watson | 84/1.13 |
| 3,809,789 | 5/1974 | Deutsch | 84/1.01 |
| 4,085,644 | 4/1978 | Deutsch et al. | 84/1.01 |
| 4,132,140 | 1/1979 | Chibana | 84/1.11 |
| 4,138,915 | 2/1979 | Nagai et al. | 84/1.22 |
| 4,142,432 | 3/1979 | Kameyama et al. | 84/1.01 |
| 4,184,403 | 1/1980 | Whitefield | 84/1.11 |
| 4,205,575 | 6/1980 | Hoskinson et al. | 84/1.01 |
| 4,224,856 | 9/1980 | Ando et al. | 84/1.19 |
| 4,227,433 | 10/1980 | Chibana | 84/1.01 |
| 4,227,435 | 10/1980 | Ando et al. | 84/1.19 |

*Primary Examiner*—Stanley J. Witkowski
*Attorney, Agent, or Firm*—Sanford J. Piltch

[57] ABSTRACT

A method and apparatus for interpolating between the harmonic structures of a waveform stored in memory during the transient periods of said waveform. In an electronic musical instrument having a greater number of selectively actuable switches than generators to cause the production of sound corresponding to the respective notes of the musical scale the present invention interpolates between the harmonic structures of a waveform stored in memory during the transient period of that waveform. This is accomplished through the use of memory units having a number of locations or zones within each memory where the number of zones is equivalent to the number of discrete harmonic structures. The first of the memory units contains a discrete fixed harmonic structure in each of its zones, and a second of the memory units contains a difference value in each of its zones where the difference value is equal to the difference between the discrete fixed harmonic structure in adjacent zones of the first memory. Each of the memory units is addressed by a means for generating addresses for selectively reading out from each of the zones of each of the memories the respective values therein which are converted to an analog current and scaled to provide correlating magnitudes so that the converted and scaled voltages may be summed to form the interpolated harmonic structures of the waveform. These interpolated harmonic structures are then scaled by a waveform envelope and fed into an audio amplifier for reproducing the waveform as audible sound through a suitable sound transducing device. The different transient periods of the waveforms are detected by this scheme and cause either an attack or a decay type waveform to be generated.

24 Claims, 10 Drawing Figures

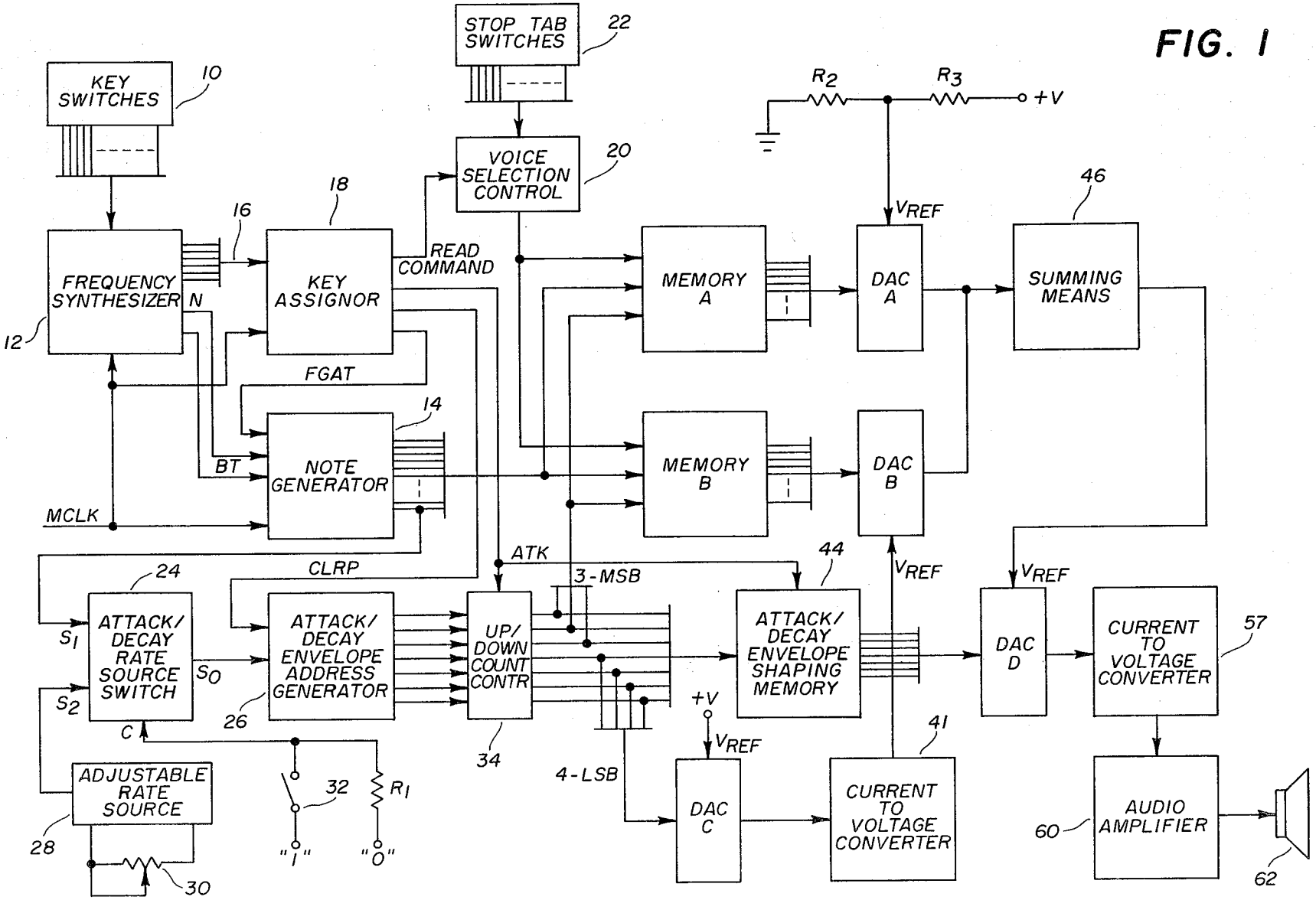
FIG. 1
KEY SWITCHES
10
FREQUENCY SYNTHESIZER
12
16
N
KEY ASSIGNOR
18
FGAT
BT
NOTE GENERATOR
14
MCLK
CLRP
STOP TAB SWITCHES
22
VOICE SELECTION CONTROL
20
READ COMMAND
R2
R3
+V
VREF
DAC A
DAC B
MEMORY A
MEMORY B
SUMMING MEANS
46
ATTACK/ DECAY ENVELOPE SHAPING MEMORY
44
3-MSB
ATK
UP/ DOWN COUNT CONTR
34
4-LSB
DAC C
DAC D
CURRENT TO VOLTAGE CONVERTER
41
CURRENT TO VOLTAGE CONVERTER
57
AUDIO AMPLIFIER
60
62
ATTACK/ DECAY ENVELOPE ADDRESS GENERATOR
26
ATTACK/ DECAY RATE SOURCE SWITCH
24
S1
S2
S0
C
R1
32
"0"
"1"
ADJUSTABLE RATE SOURCE
28
30

FIG. 7
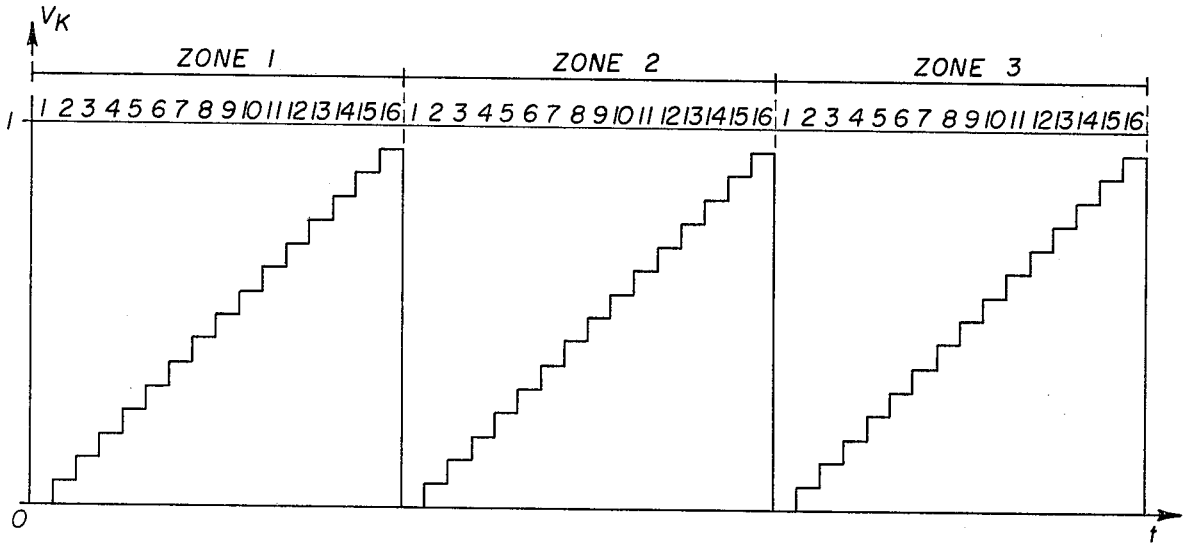
FIG. 8
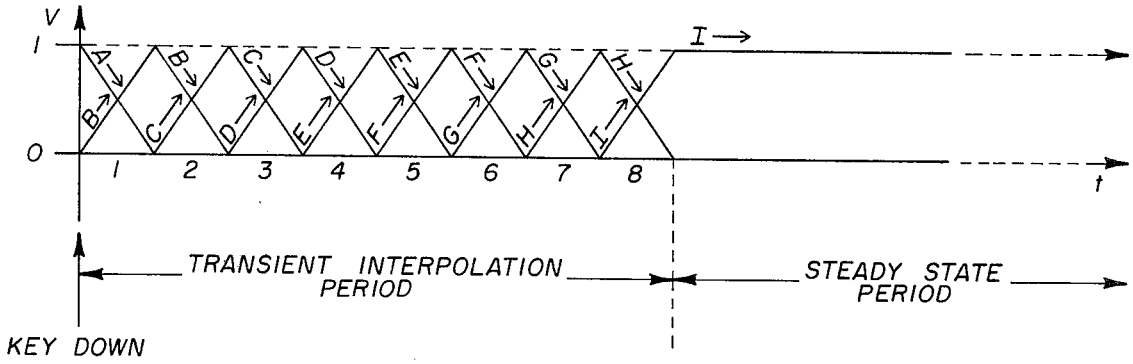
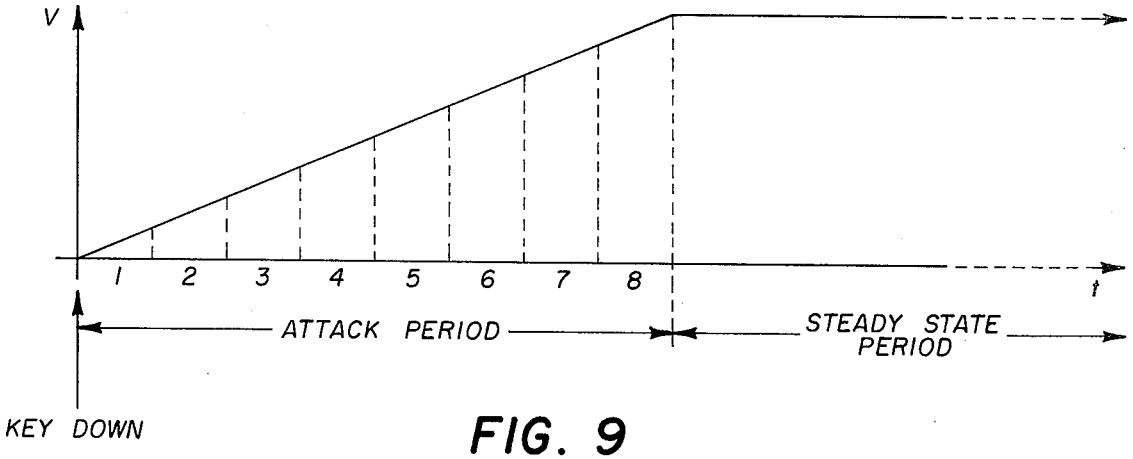
FIG. 9

TRANSIENT HARMONIC INTERPOLATOR FOR AN ELECTRONIC MUSICAL INSTRUMENT

BACKGROUND OF THE INVENTION

Most, if not all, musical instruments produce varying degrees of harmonic change with time as they are played. Some instruments exhibit this change during the onset of tone production and then settle down harmonically to a "steady state" condition. Examples of such instruments would be horns, bowed strings, and organ pipes. There are other instruments where the harmonic change occurs throughout the audible sound production. Examples of these would be plucked strings, bells and the piano. In synthesizing the sounds of musical instruments electronically, harmonic changes with time are an important contribution to realism.

In presently manufactured electronic musical instruments, harmonic variations with time have been implemented with varying degrees of success. One such approach is described in U.S. Pat. No. 4,184,403, assigned to the assignee of the present invention, wherein waveform generation is accomplished by successively reading out amplitude samples a waveform from a memory. The harmonic content of the voice or audible tone being generated is caused to change by reading from multiple memories singly but in sequence where each memory contains a slightly different harmonic content. The major deficiency in reproducing audible tones in the manner just described is the fact that under certain circumstances, such as a long, gradual decay, it becomes apparent to the listener that a sequence of discrete harmonic structures is being generated as opposed to a smooth or gradually changing harmonic sequence.

It is therefore an object of the present invention to eliminate the stepped or discrete sequence of harmonic structures as noted by a listener of the reproduced audible tone by providing interpolation between the discrete harmonic structures stored in the memory.

It is another object of the present invention to be able to interpolate between the discrete harmonic structures of the tone or note without introducing quantizing errors which may cause distortion to the listener.

It is still a further object of the present invention to control the rate at which the interpolation between the discrete harmonic structures proceeds in order to adjust such rate to one which most closely approaches the actual transient harmonic of the selected voice.

Other objects will appear hereinafter.

SUMMARY OF THE INVENTION

These objectives may be achieved by adding an additional set of memories or a second memory unit containing a number of zones, the number of zones being equal to the number of discrete harmonic structures desired during a transient period. Each of the zones in the first memory unit contains a fixed harmonic structure. The information contained in each zone of the second memory unit is the difference in amplitude between each sample point of the discrete fixed harmonic structure in a particular zone and the discrete fixed harmonic structure found in the adjacent zone of the first memory unit. During the time in which a discrete fixed harmonic structure is being read out from any given zone of the first memory, the corresponding difference value will be read out of the second memory. The difference value from the second memory will be gradually scaled during the time the first memory continues to read out the harmonic structure of a single zone. The means for scaling operates in an ascending fashion, from zero to full value, when the transient period is the attack period of the tone and in a descending fashion, from full value to zero, during the decay period. Outputs of the two memory units are summed resulting in a gradual change in the harmonic content of the reproduced tone or note during that zone time. The memories continue to advance from zone to zone with the means used for scaling reset to its initial value in preparation for another interpolation sequence as the next successive zone is addressed. The scaling and adding functions referred to are accomplished through the use of multiplying DACs in a hybrid digital/analog fashion such that quantizing errors which occur in the manipulation of digital values will not be introduced.

The present invention functions so as to interpolate between the harmonic structures of a waveform stored in memory during the transient periods of said waveform. In an electronic musical instrument having a greater number of selectively actuable switches than note generators to cause the production of sound corresponding to the respective notes of a musical scale wherein an apparatus, consistent with the present invention for interpolating between harmonic structures of a waveform stored in memory during the transient period of that waveform, comprises certain memory units having a number of locations or zones within each memory where the number of zones is equivalent to the number of discrete harmonic structures. The first of the memory units contains a discrete fixed harmonic structure in each of its zones, and a second of the memory units contains a difference value in each of its zones where the difference value is equal to the difference between the discrete fixed harmonic structures in adjacent zones of the first memory. Each of the memory units is addressed by a means for generating addresses, where the upper segment of the generated address corresponds to the zone address of each memory, for selectively reading out from each memory the contents of each zone. The discrete fixed harmonic structures read out of the selected zones of the first memory are converted to an analog current and scaled by a first scaling means using a scaling factor having a fixed value. The difference values read out of the selected zones of the second memory are also converted to an analog current and scaled by a second scaling means using a scaling factor which varies in accordance with the lower segment of the generated address. The analog representation of the scaled fixed harmonic structures read out of selected of the first memory are combined by a summing means with the analog representation of the scaled difference values read out of selected zones of the second memory and used as the scale factor in a third scaling means for scaling a waveform envelope generated by an envelope shaping means in accordance with the generated address. The interpolated harmonic structures of the waveform are then fed into an audio amplifier connected to a sound transducer, such as a speaker, for reproducing the waveform as audible sound.

The means for generating addresses comprises a means for detecting a transient period of the harmonic structure of the waveform. This transient period may be either an attack or decay period. The address generating means further comprises means for generating either a monotonically increasing address during an attack period or a monotonically decreasing address during a decay period. Also included in the address generating means is means for selectively controlling the rate of change of the generated address comprising a switching means, a fixed pulse rate source and an adjustable pulse rate source. The upper segment of the generated address comprises the three most significant bits of the generated address and the lower segment of the generated address comprises the four least significant bits of the generated address. The second scaling means varies from its least scale value to its greatest scale value during an attack period and varies from its greatest scale value to its least scale value during a decay period.

BRIEF DESCRIPTION OF DRAWINGS

For the purposes of illustrating the invention, there are shown in the drawings forms which are presently preferred; it being understood, however, that the invention is not limited to the precise arrangements and instrumentalities shown.

FIG. 1 is a schematic diagram, in the form of a block diagram, of an electronic musical instrument embodying an apparatus for interpolating transient harmonic structures in accordance with the present invention.

FIG. 7 is a graph showing the difference between the adjacent discrete fixed harmonic structures as they vary within each zone.

FIG. 8 is a graph representing the harmonic interpolation sequence over the eight zones during the transient period corresponding to the attack period of a reproduced tone.

FIG. 9 is a graph depicting the increasing value of the transient harmonic structure during the attack period.

DETAILED DESCRIPTION OF THE PREFERRED EMBODIMENT OF THE INVENTION

Figure 2:
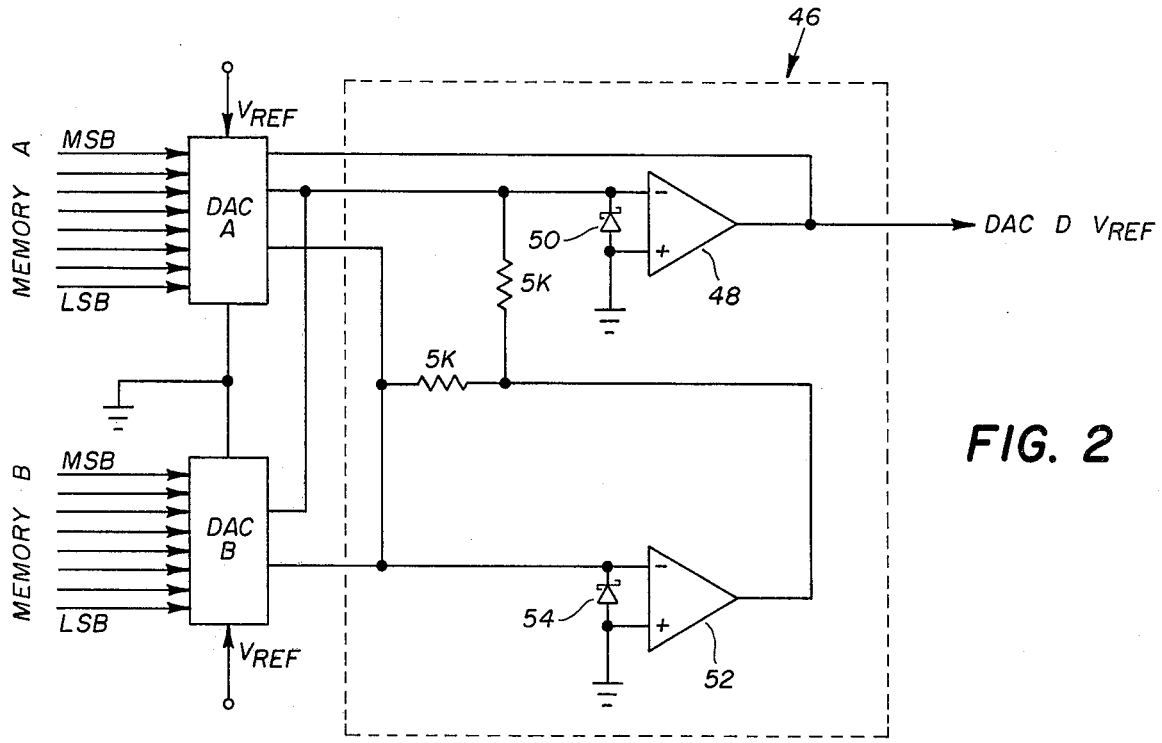
FIG. 2 is a block diagram of the first and a part of the second scaling means and the summing means of the present invention.

The following detailed description is of the best presently contemplated modes of carrying out the present invention. This description is not intended in a limiting sense, but is made solely for the purpose of illustrating the general principles of the invention.

Referring now to the drawings in detail, wherein like numerals indicate like elements, there is shown in FIG. 1 a schematic diagram, in block form, of an electronic musical instrument embodying the present invention. An electronic musical instrument or digital electronic musical instrument in which the present invention may be applied and used is described in detail in U.S. Pat. No. 3,610,799 and 3,639,913 which are assigned to the assignee of the present invention. Reference may be had to these patents for detailed descriptions of components referred to herein other than the instant invention producing structural relationships in accordance with the invention. In addition, the attack/decay envelope address generator of the present invention as it relates to frequency synthesization and key assignment logic is described in U.S. Pat. 3,610,805 which is also assigned to the assignee of the present invention. Reference may also be had to this patent for detailed descriptions of components referred to herein other than the instant invention producing similar structural relationships in accordance with the invention.

In FIG. 1, there is shown a set of keys or key switches 10 making up the keyboard of the electronic musical instrument. The key switches 19 are used in the generic sense and will be referred to herein as keys, being the keys of various electronic musical instruments. The activity of a key, the actuation or depression and release thereof, is encoded in a time-division multiplexed format in accordance with the teachings of U.S. Pat. No. 3,610,799. The time-division multiplexed signal proceeds to frequency synthesizer 12 which generates a frequency number N corresponding to the actuated key. The frequency number N is generated in a serial format and proceeds to note generator 14. Note generator 14 denotes a number of note generators in accordance with the teachings of the previously mentioned patent. However, it is to be understood that the number of note generators could be limited to one if only a single note is required to sound at a time. The frequency synthesizer 12 also generates a timing pulse, BT, which is used for internal timing functions in the note generators. The internal timing functions in the note generators refer to the $12\mu$ second time slots allotted to each multiplexed channel, each channel corresponding to a note generator. Frequency synthesizer 12 also supplies keyboard division, octave and note information along lines 16 to the key assigner 18. Key assigner 18 generates a claiming pulse, FGAT, for claiming any one of the note generators in note generator 14 in accordance with the internal timing functions. Frequency synthesizer 12, note generator 14, and key assigner 18 are each controlled by a master system clock, MCLK. For a more detailed explanation of the interrelationship of these devices reference should be made to the above-listed patents which are incorporated herein by reference.

The note generator 14 generates an address which is transmitted to each of the memories, A and B, to provide the correct memory location to be read out within the multiplexing scheme of the keyboard musical instrument. An appropriately chosen output line of the address from note generator 14 is used to control the attack/decay rate which will be described more fully hereinafter.

Concurrently, with the generating of a memory address from generator 14, the key assigner 18 generates a read command to the voice selection control 20. The voice selection control 20 senses which of the stop tab switches 22 are selected and generates an address to memories A and B which designate the memory locations of a specific voice or voices in accordance with the setting of the stop tab switches 22. The memory address from the voice selection control 20 is generated simultaneously with the memory address from the note generator 14. In this manner, which is in accordance with the teachings of the previously referenced patents, the information from the desired memory locations is read out of each of the memories A and B.

The key assigner 18 also generates two additional signals. These are a clear pulse signal, CLRP, and an attack transient detection signal, ATK. These signals will be described more fully hereinafter.

Figure 6:
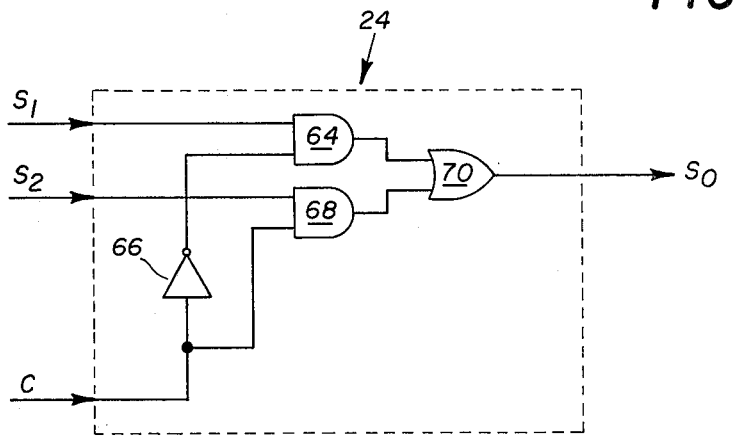
FIG. 6 is a detailed logic diagram of the attack/decay rate course switch of the present invention.

In the preferred embodiment the least significant address bit generated by note generator 14 is used as one of the two inputs to the attack/decay rate source switch 24. However, any one of the address bits generated by note generator 14 may be used as a pulse rate input to switch 24. The choice of which address bit to use depends on its recurrence rate and whether it is desirable to have a faster or slower rate, the least significant bit line having the fastest rate. The switch 24 may be an electronic switch or any other type switch of similar configuration known to one skilled in the art. The least significant address bit, which is applied to the S1 input of the attack/decay rate source switch 24, provides a fixed rate source, proportional to the frequency of the key being depressed, for the attack/decay envelope address generator 26. An adjustable rate source 28 is attached to the rate source switch 24 at S2. The adjustable rate source 28 comprises a count source which may be a 555 timer, a voltage controlled oscillator, or an equivalent thereto such as can be constructed by one skilled in the art and a variable electrical resistive device for regulating the pulse rate of the count source. It is preferred that a 555 timer be used whose pulse rate is regulated by the variable potentiometer 30. The attack-/decay rate source switch 24 controls the source of the pulse rate to the attack/decay envelope address generator 26. The switch 24 is maintained in its fixed rate source input state by resistor R1 which is connected to a logical "0". A switch 32, which may be either a separate switch or included as part of one of the special effect stop tab switches, when closed, effects the switching of the attack/decay rate source switch 24 from its S1 input to its S2 input. The switch 32 is connected at one end to the switch 24 and at its other end to the logical "1". As can be seen from FIG. 6, the rate source switch 24 has inputs S1, S2 and C. The S1 and S2 inputs are connected as described above. The C input is connected to one pole of the switch 32 and to the resistor R1. The S1 input is connected to one input of AND gate 64 with the other input of gate 64 connected through inverter 66 to the C input. The S2 input is connected to one input of AND gate 68 with the other input of gate 68 connected to the C input. The outputs of AND gates 64, 68 are connected to the input of OR gate 70 whose output is the output of rate source switch 24, S0. As long as the C input is held low by the logical "0" through resistor R1 the switch 24 will remain connected to the S1 input. When switch 32 is closed causing the C input to go high in response to the logical "1", rate source switch 24 will switch to its S2 input. Thus, the rate source for the attack/decay envelope address generator 26 from output SO of rate source switch 24 is controlled by the switch 32. The attack/decay envelope address generator 26 provides for the reading out of an address based on the count of a counter included in the envelope address generator 26. The count rate is determined by either one of the sources of rate source switch 24. The envelope address generator 26 functions in a multiplexed manner in accordance with the abovementioned patents wherein it has as many channels as there are note generators in note generator 14. The clear pulse, CLRP, generated by key assigner 18, functions to reset the counter of the envelope address generator 26 to zero on the channel corresponding to its occurrence in the multiplexed timing scheme. For a more detailed explanation of the interrelationship of the envelope address generator reference should be made to U.S. Pat. No. 3,610,805 which is incorporated herein by reference.

Figure 5:
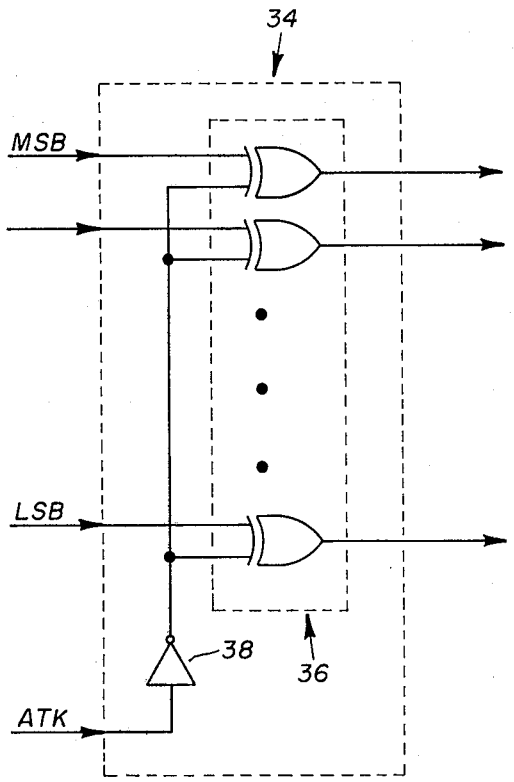
FIG. 5 is a logic diagram of the up/down count controller of the present invention.

The address from the attack/decay envelope address generator 26 contains seven bits which are transmitted to an up/down count controller 34. The transient attack detection signal, ATK, generated by key assigner 18 is sensed by the up/down count controller 34 so that when the ATK signal is present the count controller 34 permits an increasing count and when the ATK signal is absent the count controller permits a decreasing count. Referring to FIG. 5, the up/down count controller 34 comprises a set of exclusive OR gates 36 equivalent in number to the number of address lines from the attack-/decay envelope address generator 26. One input of each of these exclusive OR gates 36 is connected to each of the address lines of the envelope address generator 26. The other input of each of the exclusive OR gates 36 is connected to the ATK signal line through an inverter 38. The presence or absence of the ATK signal will control the output of the count controller 34 as described above.

Figure 3:
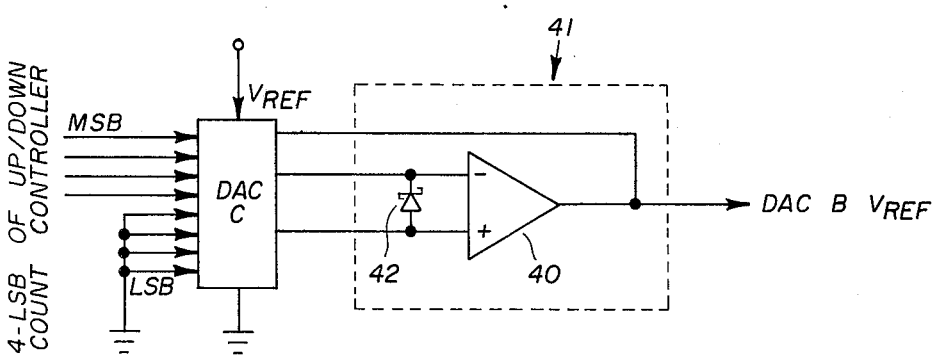
FIG. 3 is a block diagram of a part of the second scaling means of the present invention.

The output of the up/down count controller 34 is used in the following way. The three most significant bits are used to address the memories A and B providing for the reading out of the information stored in the desired memory location or zone in accordance with the value of the address. The four least significant bits of the output are used as the inputs to DAC C as shown in FIG. 3. The four least significant bits of the up/down count controller 34 are connected to the four most significant bit inputs of DAC C. The four least significant bits of DAC C are connected to ground so as not to interfere with the operation of DAC C. DAC C is a multiplying digital to analog converter similar to Analog Devices AD7523. The outputs of such devices have currents which are proportional to the product of its digital input code and its analog reference voltage. The outputs of DAC C are fed into the inverting and noninverting inputs of an operational amplifier with the output of the amplifier in a feedback loop to the DAC. A Schottky diode is placed across the inputs of the operational amplifier to protect the DAC by peventing its failure during start up. The configuration is a standard current to unipolar voltage scheme recommended by the DAC manufacturer. The operational amplifier 40 comprises a current to voltage converter 41 having an output voltage which is used as the reference voltage applied to DAC B. The Schottky diode 42 is included within the current to voltage converter 41 only for the purpose of showing its proximity to the operational amplifier 40. The diode 42 has no effect on the converting process. The reference voltage applied to DAC C has a positive value which will be discussed hereinafter. The output of DAC C and, therefore, the voltage reference input to DAC B will vary in accordance with the value of the input to DAC C from the count controller 34 and the voltage present at the voltage reference to the DAC. Thus the output of DAC C will vary between zero and full scale in a steplike manner according to the value of the output of the count controller 34.

The entire output of the up/down count controller 34 is applied to the input of the attack/decay envelope shaping memory 44. The envelope shaping memory 44 is also connected to the ATK signal line so that either an attack type envelope or a decay type envelope may be generated depending on the presence or absence of the ATK signal. The output of the attack/decay envelope shaping memory 44 will be discussed in connection with the operation of DAC D.

Figure 10:
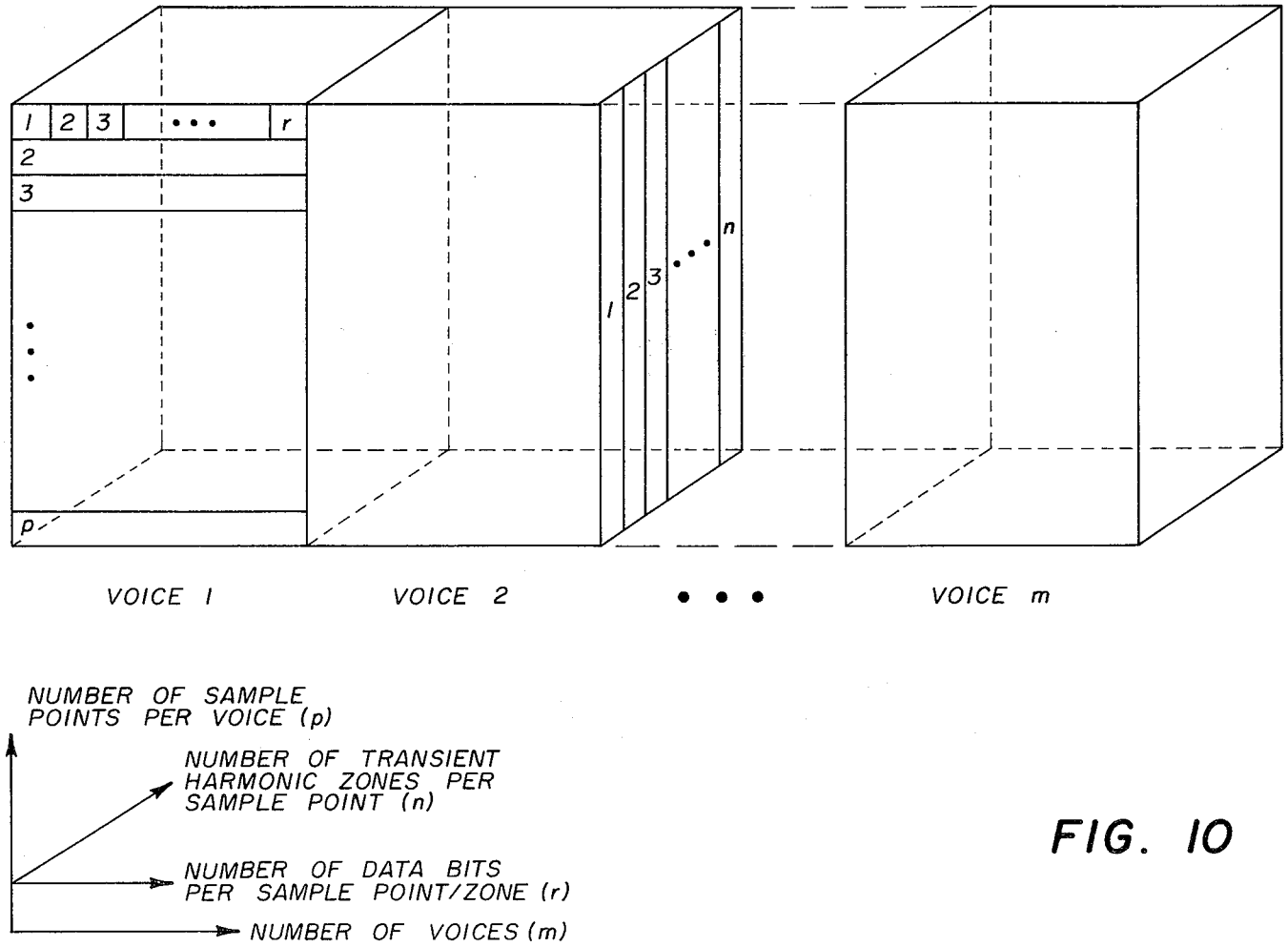
FIG. 10 is a graphical representation of the configuration of each memory unit of the present invention.

The three most significant bits of the up/down count controller 34 complete the memory address for each of the memories A and B. Memory A contains harmonic transient structures for a preselected number of voices which are accessed and read out of the memory according to the addresses received from the voice selection control 20, note generator 14, and the up/down count controller 34. Memory B is accessed in the same manner as Memory A and contains in its memory locations difference values which will be more fully described hereinafter. The memories A, B are read only memories, ROMs, structured in sections according to voice. Each of the voice sections, m, is divided into a number of transient harmonic zones, n, each zone containing a number of waveform sample points, p, having a fixed number of bits, r. For the present invention it is preferred that there be eight zones. While it has been found that eight zones are preferable, any number of zones may be used with the only constraint on the number of zones being the size of the memory. See FIG. 10.

Each zone in memory A contains a discrete fixed harmonic structure representing the tone color of an organ voice at a preselected time during the transient period of the waveform. This transient period being either the attach period or the decay period for the voice. Each of these eight zones is labeled A through H as shown in Table 1. A ninth zone, not actually represented in memory A, is labeled I. This ninth zone represents the steady state harmonic structure of the selected voice. The sequence of the transient harmonic structures read out of the zones of the memory during a transient period is controlled by the three most significant bits of the up/down count controller 34. If the ATK signal is present, the up/down controller 34 provides an increasing three bit count varying from 0 through 7 for addressing the zones of memory A in ascending sequence from 1 to 8. If the ATK signal is absent, then a decay transient period is detected and the up/down count controller 34 inverts its count providing a decreasing address from 7 to 0 to memory A. Thus the information contained in the zones of memory A are read out in reverse fashion from 8 to 1. It should be noted that the ATK signal is present during both the attack transient time and the steady state harmonic period and absent during a decay transient time.

Memory B is structured in the same manner as memory A preferably containing 8 zones. The information contained in each zone is the algebraic difference between the discrete harmonic structures found in two adjacent zones of memory A. This difference value is expressed in the following relationship:

$$L_n = \frac{J_{n+1} - J_n}{2} \qquad \text{Formula (1)}$$

where L represents the transient harmonic structure in memory B, J represents the transient harmonic structure in memory A and n represents the number of the zone. As n varies from 1 to 8, $J_n$ varies from A to H and $J_{n+l}$ varies from B to I. It therefore follows from the above relationship that as n varies from 1 to 8, $L_n$ varies from [B−A]/2 to [I−H]/2 as shown in Table 1.

TABLE 1

| n | J | L |
|---|---|---|
| 1 | A | [B-A]/2 |

TABLE 1-continued

| n | J | L |
|---|---|---|
| 2 | B | [C-B]/2 |
| 3 | C | [D-C]/2 |
| 4 | D | [E-D]/2 |
| 5 | E | [F-E]/2 |
| 6 | F | [G-F]/2 |
| 7 | G | [H-G]/2 |
| 8 | H | [I-H]/2 |
| 9 | I | |

The two in the denominator of the expression is required so that the calculated values for L can be stored in memory B without error, quantizing or otherwise. To further clarify this, if memories A and B are organized as 8×p bit devices, where p 8 bit amplitude samples are stored, the maximum allowable peak amplitude for any wave shape would be ±128 unit amplitude steps. It is possible that, in calculating the difference information for memory B, the result could exceed the 128 unit amplitude figure by a maximum of 2. This would occur if the value for a given sample point in zone 1 was +128 while in zone 2 its value was −128. Therefore by dividing the calculated difference between the harmonic structures in two adjacent zones of memory A by a factor of two, the resulting difference value will fit within the ±128 unit amplitude step limits of memory B. The sequencing of the zones of memory B is identical and simultaneous to the sequencing of the zones of memory A by virtue of a similar address consisting of the three most significant bits from the output of the up/down count controller 34.

The outputs from the memories A and B are connected to the inputs to DAC A and DAC B respectively. DAC A is a multiplying digital to analog converter similar to Analog Devices AD7523 whose output currents are proportional to the product of its digital input and its analog reference voltage input. The reference voltage for DAC A is determined by the value of resistors R2, R3 and a supply voltage, +V. The supply voltage to the reference voltage input of the digital-/analog converting devices has been chosen in accordance with the manufacturer's recommendation of a range between +10 V and −10 V. It is preferred that the supply voltage +V be in the range of +5 V to +10 V. This value is to be considered the unit value of the reference voltage and will be discussed more fully hereinafter. DAC B is also a multiplying digital to analog converter similar to the AD7523 where the reference voltage input varies with time. The reference voltage input to DAC B is the output of current to voltage converter 41 and DAC C which varies between 0 and its full scale value which is equal to the reference voltage input applied to DAC C. DAC C varies over this range in sixteen steps according to the digital code applied to its input by the four least significant bits from the up/down count controller 34. The correlation between the four least significant and the three most significant bits of the envelope address from up/down count controller 34 permit the output of DAC C to vary over its full scale once for each zone in the memories A and B. This is to say that for each zone which is addressed in the memories A and B the output of DAC C and, therefore, the voltage reference to DAC B varies over its full scale. Referring to FIG. 7, during the time period occupied by one of the zones containing the transient harmonic structures, as dictated by the three most significant outputs of the up/down count controller 34, the reference voltage input to DAC B gradually increases from 0 volts to a maximum value in 16 steps in an ascending linear feashion. The reference voltage input to DAC B controls the scaling function of the DAC and is indicated in the Figure as $V_K$. The ascending quality of the graph will exist if the ATK signal is present. If the ATK signal is absent, the up/down count controller 34 will invert its input information. DAC C will begin at its full scale value supplying initially to the voltage reference of DAC B a full scale voltage reference creating a descending linear value progression over the transient period.

The outputs of DAC A and DAC B are supplied to summing means 46 where the output currents of both DAC A and DAC B are added and converted to a voltage. The configuration of summing means 46, as shown in FIG. 2, is a standard current to bipolar voltage scheme recommended by the manufacturer. By its very nature this configuration performs a current summing function familiar to those skilled in the art. Both DAC A and DAC B have complimentary current outputs. Two similar outputs of DAC A and DAC B are connected together and also connected to the inverting input of operational amplifier 48. The noninverting input of operational amplifier 48 is connected to ground. Connected across the inputs is a Schottky diode 50 placed there to prevent damage to the digital to analog converters by preventing their failure during start up. The other similar outputs of DACs A and B are also connected together and connected to the inverting input of operationl amplifier 52. The noninverting input of operational amplifier 52 is connected to ground and a Schottky diode 54 is connected across the input for protection of the digital to analog converting devices as described above. The output of operational amplifier 52 is connected in a feedback loop through a 5 Kohm resistive divider network to each of the lines of both DACs A and B which are connected to the noninverting inputs of the operational amplifiers 48, 52. The output of operational amplifier 48 is connected through a feedback loop to an auxiliary input to DAC A. Each of the digital to analog converting devices, DAC A and DAC B, receive digital input from the memories A and B respectively. The digital input is converted within the digital to analog converting devices in a manner known to those skilled in the art using the reference voltage inputs. The reference voltage to DAC A is divided in half so that when the output of DAC A is summed with the output of DAC B it will be properly scaled with regard to magnitude. For this reason the voltage applied to the reference voltage input of DAC C is full value, +V, so that the magnitudes of DAC A and B correspond when summed.

The output of summing means 46 is used as the reference voltage for DAC D and can be expressed by the following relationship:

$$V_n = J_n + V_K L_n \qquad \text{Formula (2)}$$

where V represents the output voltage from the summing means 46, J represents the transient harmonic structures stored in memory A, L represents the transient harmonic structures stored in memory B, $V_K$ represents the interpolation scale factor and n represents the number of the zones in memories A and B. Using the information from Table 1 and the above expression, a second table can be constructed showing the harmonic interpolation sequence for any zone. A representative table is included showing the values for each factor in the expression in each of the intrazone time periods, $t_z$. The table includes an example of a transition from zone to zone.

TABLE 2

| V | J | $V_K L$ | $V_K$ | L | $t_z$ |
|---|---|---|---|---|---|
| A | A | 0 | $\frac{0}{16}$ | $\frac{B-A}{2}$ | 1 |
| $\frac{15A}{16}+\frac{B}{16}$ | A | $\frac{B}{16}-\frac{A}{16}$ | $\frac{2}{16}$ | $\frac{B-A}{2}$ | 2 |
| $\frac{14A}{16}+\frac{2B}{16}$ | A | $\frac{2B}{16}-\frac{2A}{16}$ | $\frac{4}{16}$ | $\frac{B-A}{2}$ | 3 |
| $\frac{13A}{16}+\frac{3B}{16}$ | A | $\frac{3B}{16}-\frac{3A}{16}$ | $\frac{6}{16}$ | $\frac{B-A}{2}$ | 4 |
| $\frac{12A}{16}+\frac{4B}{16}$ | A | $\frac{4B}{16}-\frac{4A}{16}$ | $\frac{8}{16}$ | $\frac{B-A}{2}$ | 5 |
| $\frac{11A}{16}+\frac{5B}{16}$ | A | $\frac{5B}{16}-\frac{5A}{16}$ | $\frac{10}{16}$ | $\frac{B-A}{2}$ | 6 |
| $\frac{10A}{16}+\frac{6B}{16}$ | A | $\frac{6B}{16}-\frac{6A}{16}$ | $\frac{12}{16}$ | $\frac{B-A}{2}$ | 7 |
| $\frac{9A}{16}+\frac{7B}{16}$ | A | $\frac{7B}{16}-\frac{7A}{16}$ | $\frac{14}{16}$ | $\frac{B-A}{2}$ | 8 |
| $\frac{8A}{16}+\frac{8B}{16}$ | A | $\frac{8B}{16}-\frac{8A}{16}$ | $\frac{16}{16}$ | $\frac{B-A}{2}$ | 9 |
| $\frac{7A}{16}+\frac{9B}{16}$ | A | $\frac{9B}{16}-\frac{9A}{16}$ | $\frac{18}{16}$ | $\frac{B-A}{2}$ | 10 |
| $\frac{6A}{16}+\frac{10B}{16}$ | A | $\frac{10B}{16}-\frac{10A}{16}$ | $\frac{20}{16}$ | $\frac{B-A}{2}$ | 11 |
| $\frac{5A}{16}+\frac{11B}{16}$ | A | $\frac{11B}{16}-\frac{11A}{16}$ | $\frac{22}{16}$ | $\frac{B-A}{2}$ | 12 |
| $\frac{4A}{16}+\frac{12B}{16}$ | A | $\frac{12B}{16}-\frac{12A}{16}$ | $\frac{24}{16}$ | $\frac{B-A}{2}$ | 13 |
| $\frac{3A}{16}+\frac{13B}{16}$ | A | $\frac{13B}{16}-\frac{13A}{16}$ | $\frac{26}{16}$ | $\frac{B-A}{2}$ | 14 |
| $\frac{2A}{16}+\frac{14B}{16}$ | A | $\frac{14B}{16}-\frac{14A}{16}$ | $\frac{28}{16}$ | $\frac{B-A}{2}$ | 15 |
| $\frac{A}{16}+\frac{15B}{16}$ | A | $\frac{15B}{16}-\frac{15A}{16}$ | $\frac{30}{16}$ | $\frac{B-A}{2}$ | 16 |
| B | B | 0 | $\frac{0}{16}$ | $\frac{C-B}{2}$ | 1 |

Since the reference voltage into DAC C, which may be referred to as having unit value, is twice the reference voltage into DAC A, then the interpolation scale factor $V_K$, which is the output of DAC C, will vary from zero to two units. This is reflected in FIG. 8 which shows another representation of the interpolation process. The harmonic structure B builds from a value of zero at key down to unit value by the end of zone one and then decreases to zero again by the end of zone two. Contemporaneously harmonic structure A decreases from unit value at key down to a value of zero at the end of zone one as harmonic structure C begins to build to unit value which is reaches at the end of zone two. The transient interpolation period shown in FIG. 8 represents as ascending value of the transient harmonic structures in each of the zones and, thus, represents an attack transient period. The decay transient period functions in a similar manner with a representation similar to that shown in FIG. 8 but in reverse from the one shown with respect to time.

Figure 4:
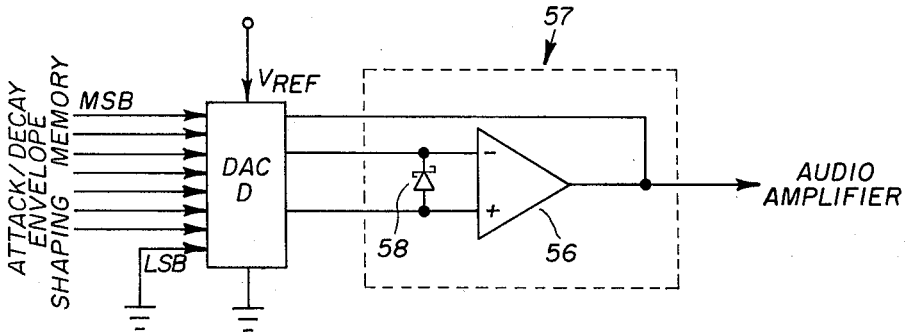
FIG. 4 is a block diagram of the third scaling means of the present invention.

The output of summing means 46 is used as the voltage reference input to DAC D, another multiplying digital to analog converter similar to the AD7523. With reference to FIGS. 1 and 4, the digital input to DAC D comes from the attack/decay envelope shaping memory 44 in the form of a seven bit address. The attack-/decay envelope shaping memory is a read-only memory, ROM, in which an attack or decay envelope shape is stored as the sampled waveform. The envelope shaping memory 44 is organized in two sections. The memory 44 is a $7 \times r$ bit device where either the attack or the decay section of memory is addressed depending upon the presence or absence of the ATK signal. The memory location address for the envelope shaping memory 44 is the entire output of the up/down count controller 34. DAC D accepts seven input lines from the envelope shaping memory 44 having its least significant bit connected to ground. As in the case of the other multiplying digital to analog converters, DAC D has an operational amplifier 56 with each of its inputs connected to one of the outputs of the digital to analog converting device. A Schottky diode 58 is connected across the inputs of the operational amplifier 56 to protect DAC D from failure during start up of the apparatus. The output of operational amplifier 56 is connected in a feedback arrangement to an auxiliary input to DAC D and is connected to an audio amplifier. This circuit configuration is a standard current to unipolar voltage scheme recommended by the digital to analog converting device manufacturer which is familiar to those skilled in the art.

DAC D performs the function of combining the interpolated transient harmonic structures with the appropriate transient period envelope. One example of a transient or attack period envelope and how it relates to the zones of the present invention is shown in FIG. 9. This figure exactly correlates to the transient harmonic interpolations of FIG. 8. Thus, the output of DAC D is the product of the transient harmonic structure interpolation sequence and the transient or attack period envelope of FIGS. 8 and 9 respectively.

The output current from DAC D is fed into the current to voltage converter 57 which is comprised of the operational amplifier 56. The Schottky diode 58 is included within the current to voltage converter 57 only for the purpose of showing its proximity to the operational amplifier 56. The diode 58 has no effect on the converting process. The output from the current to voltage converter 57 is fed into audio amplifier 60. The output of audio amplifier 60 goes to a standard sound transducing device such as a speaker 62 which creates the audible sound of the selected voices corresponding to the actuated keys of the electronic musical instrument.

Thus the present invention eliminates the stepped or discrete sequence of harmonic structures noted by the listener to the reproduced tones of prior electronic musical instruments by the method of interpolation between discrete harmonic structures stored in its memory. Additionally, by providing for the scaling of the harmonic structures while in analog form, the interpolation is accomplished without introducing quantizing errors which would occur if scaling were attempted on digital values. The interpolating of analog values also virtually eliminates distortion caused by operating on digital values as discerned by the listener.

Further, the present invention provides for the varying of the rate of interpolation between discrete harmonic structures to achieve control over the transient harmonic structures of the audible tones which are reproduced using the above-described method and apparatus. The rate control capability enables the present invention in cooperation with an electronic musical instrument to more closely approach the actual transient harmonic structure of the selected voice.

The present invention may be embodied in other specific forms without departing from the spirit or essential attributes thereof and, accordingly, reference should be made to the appended claims rather than to the specification as indicating the scope of the invention.

We claim:

1. In an electronic musical instrument having a greater number of selectively actuable switches than note generators to cause the production of sounds corresponding to the respective notes of a musical scale, an apparatus for interpolating between harmonic structures of a waveform stored in memory during the transient periods of said waveform comprising;

at least first and second memories having a number of locations or zones in each memory, said number of zones being equivalent to the number of harmonic structures;

a fixed harmonic structure in each zone of the first memory;

a difference value in each zone of the second memory, said difference value equal to the difference between the fixed harmonic structures in adjacent zones of the first memory;

means for generating addresses for selectively reading out from each said memory the contents of each zone, said zone address being the upper segment of the generated address, for selectively controlling the scaling of the difference values read out from each zone of said second memory by a digital to analog converting means, said digital to analog converting means address being the lower segment of the generated address, and for selectively reading out of a transient waveform envelope memory a transient waveform envelope, said transient waveform envelope address being said generated address;

means for converting and scaling the fixed harmonic structure read out of a selected zone of the first memory having a scaling factor being a fixed value;

means for converting and scaling the difference value read out of a selected zone of the second memory having a scaling factor varying in accordance with the lower segment of the generated address;

summing means for combining the converted and scaled fixed harmonic structures read out of the selected zones of the first memory with the converted and scaled difference values read out of the selected zones of the second memory and generating an output;

means for converting and scaling the generated transient waveform envelope having a scaling factor in accordance with the generated output of the summing means; and, amplifying means for producing the interpolated transient harmonic structures of the waveform as sound through an audio transducing means.

2. In accordance with claim 1 wherein said means for generating addresses comprises:

means for detecting the transient period of the harmonic structure of a waveform, said transient period being either the attack or decay period;

means for generating either a monotonically increasing address during an attack period or a monotonically decreasing address during a decay period; and, means for selectively controlling rate of change of the generated address.

3. In accordance with claim 2 wherein said means for selectively controlling rate of change of the generated address comprises a switching means and at least two discrete rate sources of either adjustable or fixed rates.

4. In accordance with claim 3 wherein said adjustable rate source comprises a count source and a variable electrical resistive device for generating differing pulse rates according to the setting of said variable electrical resistive device.

5. In accordance with claim 3 wherein said fixed rate source comprises any one of a preselected address bit generated by a note generator of said electronic musical instrument for generating a pulse rate according to the recurrence rate of the preselected address bit.

6. In accordance with claim 1 wherein said upper segment of the generated address comprises the three most significant bits of the generated address.

7. In accordance with claim 1 wherein said lower segment of the generated address comprises the four least significant bits of the generated address.

8. In accordance with claim 1 wherein said scaling factor of the means for converting and scaling the difference values varies from its least value to its greatest value during an attack period and varies from its greatest value to its least value during a decay period.

9. In an electronic organ having a greater number of selectively actuable switches than note generators to cause the production of sounds corresponding to the respective notes of a musical scale, an apparatus for interpolating between harmonic structures of a waveform stored in memory during the transient periods of said waveform comprising:

at least first and second memories having a number of locations or zones in each memory, said number of zones being equivalent to the number of harmonic structures;

a fixed harmonic structure in each zone of the first memory;

a difference value in each zone of the second memory, said difference value equal to the difference between the fixed harmonic structures in adjacent zones of the first memory;

means for generating addresses for selectively reading out from each said memory the contents of each zone, said zone address being the upper segment of the generated address, for selectively controlling the scaling of the difference values read out from each zone of said second memory by a digital to analog converting means, said digital to analog converting means address being the lower segment of the generated address, and for selectively reading out of a transient waveform envelope memory a transient waveform envelope, said transient waveform envelope address being said generated address;

means for converting and scaling the fixed harmonic structure read out of a selected zone of the first memory having a scaling factor being a fixed value;

means for converting and scaling the difference value read out of a selected zone of the second memory having a scaling factor varying in accordance with the lower segment of the generated address;

summing means for combining the converted and scaled fixed harmonic structures read out of the selected zones of the first memory with the converted and scaled difference values read out of the selected zones of the second memory and generating an output;

means for converting and scaling the generated transient waveform envelope having a scaling factor in accordance with the generated output of the summing means; and, amplifying means for producing the interpolated transient harmonic structures of the waveform as sound through an audio transducing means.

10. In accordance with claim 9 wherein said means for generating addresses comprises:

means for detecting the transient period of the harmonic structure of a waveform, said transient period being either the attack or decay period;

means for generating either a monotonically increasing address during an attack period or a monotonically decreasing address during a decay period; and, means for selectively controlling rate of change of the generated address.

11. In accordance with claim 10 wherein said means for selectively controlling rate of change of the generated address comprises a switching means and at least two discrete rate sources of either adjustable or fixed rates.

12. In accordance with claim 11 wherein said adjustable rate source comprises a count source and a variable electrical resistive device for generating differing pulse rates according to the setting of said variable electrical resistive device.

13. In accordance with claim 11 wherein said fixed rate source comprises any one of a preselected address bit generated by a note generator of said electronic organ for generating a pulse rate according to the recurrence rate of the preselected address bit.

14. In accordance with claim 9 wherein said upper segment of the generated address comprises the three most significant bits of the generated address.

15. In accordance with claim 9 wherein said lower segment of the generated address comprises the four least significant bits of the generated address.

16. In accordance with claim 9 wherein said scaling factor of the means for converting and scaling the difference values varies from its least value to its greatest value during an attack period and varies from its greatest value to its least value during a decay period.

17. In an electronic musical instrument having a greater number of selectively actuable switches than note generators to cause the production of sounds corresponding to the respective notes of a musical scale, a method for interpolating between harmonic structures of a waveform stored in memory during the transient periods of said waveform comprising the steps of:

providing at least first and second memories having a number of locations or zones within each memory, said number of zones being equivalent to the number of harmonic structures;

providing a fixed harmonic structure in each zone of the first memory;

providing a difference value in each zone of the second memory, said difference value equal to the difference between the fixed harmonic structures in adjacent zones of the first memory;

providing means for generating addresses for selectively reading out from each said first memory the contents of each zone, said zone address being the upper segment of the generated address, for selectively controlling the scaling of the difference values read out from each zone of said second memory by a digital to analog converting means, said digital to analog converting means address being the lower segment of the generated address, for selectively reading out of a transient waveform envelope memory a transient waveform envelope, said transient waveform envelope address being said generated address;

providing means for converting and scaling the fixed harmonic structure read out of a selected zone of the first memory having a scaling factor being a fixed value;

providing means for converting and scaling the difference value read out of a selected zone of the second memory having a scaling factor varying in accordance with the lower segment of the generated address;

providing summing means for combining the converted and scaled fixed harmonic structures read out of the selected zones of the first memory with the converted and scaled difference values read out of the selected zones of the second memory and generating an output;

providing means for converting and scaling the generated transient waveform envelope having a scaling factor in accordance with the generated output of the summing means; and, providing amplifying means for producing the interpolated transient harmonic structures of the waveform as sound through an audio transducing means.

18. In accordance with claim 17 wherein said means for generating addresses comprises the steps of:

providing means for detecting the transient period of the harmonic structure of a waveform, said transient period being either the attack or decay period;

providing means for generating either a monotonically increasing address during an attack period or a monotonically decreasing address during a decay period; and, providing means for selectively controlling the rate of change of the generated address.

19. In accordance with claim 18 wherein said means for selectively controlling the rate of change of the generated address comprises a switching means and at least two discrete rate sources of either adjustable or fixed rates.

20. In accordance with claim 19 wherein said adjustable rate source comprises a count source and a variable electrical resistive device for generating differing pulse rates according to the setting of said variable electrical resistive device.

21. In accordance with claim 19 wherein said fixed rate source comprises any one of a preselected address bit generated by a note generator of said electronic musical instrument for generating a pulse rate according to the recurrence rate of the preselected address bit.

22. In accordance with claim 17 wherein said upper segment of the generated address comprises the three most significant bits of the generated address.

23. In accordance with claim 17 wherein said lower segment of the generated address comprises the four least significant bits of the generated address.

24. In accordance with claim 17 wherein said scaling factor of the means for converting and scaling the difference values varies from its least value to its greatest value during an attack period and varies from its greatest value to its least value during a decay period.

* * * * *